US007992674B2

(12) United States Patent
Gorny et al.

(10) Patent No.: US 7,992,674 B2
(45) Date of Patent: Aug. 9, 2011

(54) DIPOLE FLOW DRIVEN RESONATORS FOR FAN NOISE MITIGATION

(75) Inventors: Lee J. Gorny, State College, PA (US); Gary H. Koopmann, Alexandria, VA (US); Dean E. Capone, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 26 days.

(21) Appl. No.: 12/483,601

(22) Filed: Jun. 12, 2009

(65) Prior Publication Data

US 2009/0308685 A1 Dec. 17, 2009

Related U.S. Application Data

(60) Provisional application No. 61/061,352, filed on Jun. 13, 2008.

(51) Int. Cl.
*F01N 1/02* (2006.01)

(52) U.S. Cl. ..... 181/225; 415/119

(58) Field of Classification Search ..... 181/198, 181/202, 205, 224, 225; 415/119
See application file for complete search history.

(56) References Cited

U.S. PATENT DOCUMENTS

| | | | | |
|---|---|---|---|---|
| 2,297,046 | A * | 9/1942 | Bourne | 181/250 |
| 2,323,394 | A * | 7/1943 | Huntington | 181/247 |
| 6,309,176 | B1 | 10/2001 | Periyathamby et al. | |
| 6,379,110 | B1 * | 4/2002 | McCormick et al. | 415/119 |
| 6,390,770 | B1 * | 5/2002 | Takeshita | 415/119 |
| 6,710,486 | B1 * | 3/2004 | Horng et al. | 310/89 |
| 2001/0018022 | A1 | 8/2001 | Nakamura | |
| 2003/0183446 | A1 | 10/2003 | Shah et al. | |
| 2005/0161280 | A1 * | 7/2005 | Furuya | 181/225 |
| 2006/0257251 | A1 * | 11/2006 | Carlson et al. | 415/178 |
| 2007/0292261 | A1 * | 12/2007 | Tang et al. | 415/119 |

FOREIGN PATENT DOCUMENTS

| | | | |
|---|---|---|---|
| JP | 62217833 | A * | 9/1987 |
| JP | 10306972 | A * | 11/1998 |
| KR | 200418061 | A | 9/2005 |
| KR | 20070072850 | A | 7/2007 |
| WO | WO-8103201 | A1 | 11/1981 |

OTHER PUBLICATIONS

Agenda from 13th AIAA/CEAS Aeroacoustics Conference (28th AIAA Aeroacoustics Conference), May 21, 2007, see session 12 AA-12 including paper #2007-3529, http://www.aiaa.org/agenda.cfm?lumeetingid=1493.*

(Continued)

*Primary Examiner* — Jeremy Luks
(74) *Attorney, Agent, or Firm* — Gifford, Krass, Sprinkle, Anderson & Citkowski, P.C.; Douglas L. Wathen

(57) ABSTRACT

A fan system includes a rotor supported for rotation about a fan axis. The rotor has a central hub and a plurality of blades each extending outwardly from the hub to a tip. The rotor blades define a rotor plane perpendicular to the fan axis. A first acoustic resonator has an opening disposed on a first side of the rotor plane and a second acoustic resonator has an opening disposed on a second side of the rotor plane. The acoustic resonators are configured to provide a dipole resonator system operable to at least partially reduce a blade pass frequency tone in an upstream and a downstream direction simultaneously.

20 Claims, 8 Drawing Sheets

OTHER PUBLICATIONS

Gorny LJ, et al. Attenuation of ducted axial propulsor's blade tone noise using adaptively tunable resonators. AIAA 2007-3529 (13th AIAA/CEAS Aeroacoustics Conference, Rome, Italy, 2007).

Gorny LJ and W Neise. Modeling of adaptively tunable flow driven resonators for axial fan blade tone noise attenuation. INCE Noise-Con, Oct. 2007.

Gorny LJ and DE Capone. Use of dipole resonator configurations for bi-directional attenuation of plane wave blade tone noise propagations. INCE Noise-Con, Jul. 2008.

Neise W and GH Koopmann. Reduction of centrifugal fan noise by use of resonators. Journal of Sound and Vibration 1980, 73(2): 297-308.

Koopmann GH and W Neise. The use of resonators to silence centrifugal blowers. Journal of Sound and Vibration 1982, 82(1): 17-27.

Gorny LJ and GH Koopmann. Axial fan blade tone cancellation using optimally tuned quarter wavelength resonators. Journal of Vibration and Acoustics, (1312) 2009.

Gorny LJ, et al. A method to predict the canceling response of flow-excited resonators for the reduction of axial turbomachine noise. INCE Inter-noise, Aug. 2009.

* cited by examiner

FIG. 1
PRIOR ART
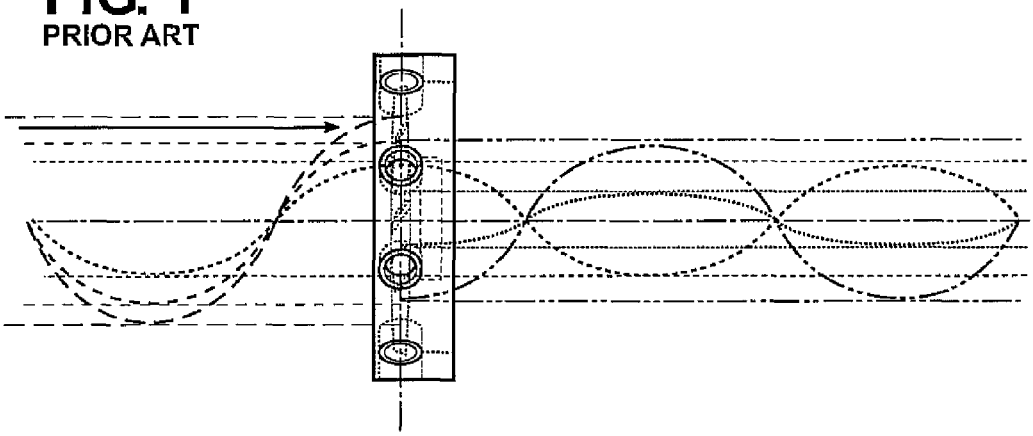
FIG. 2
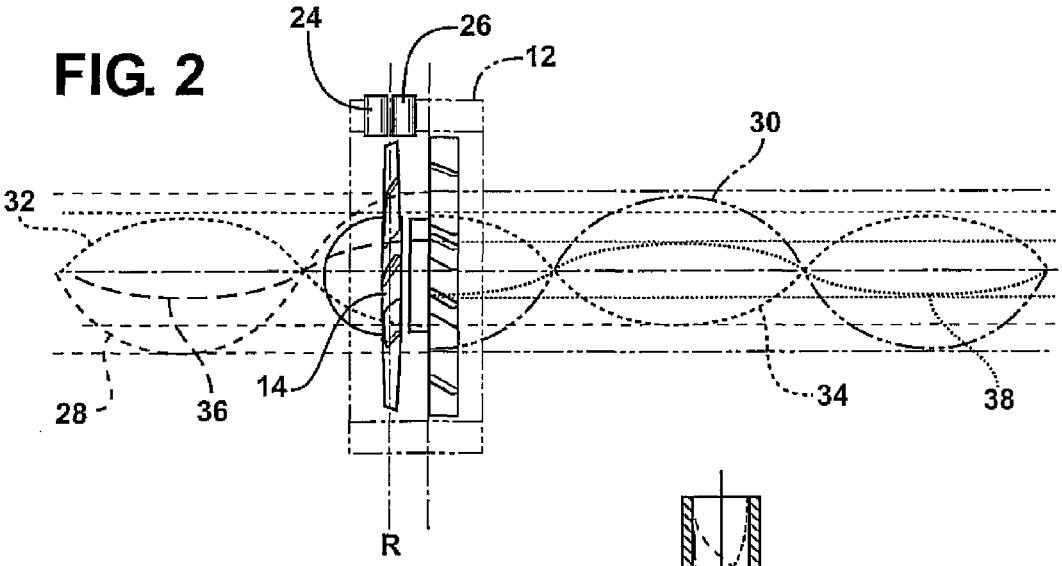
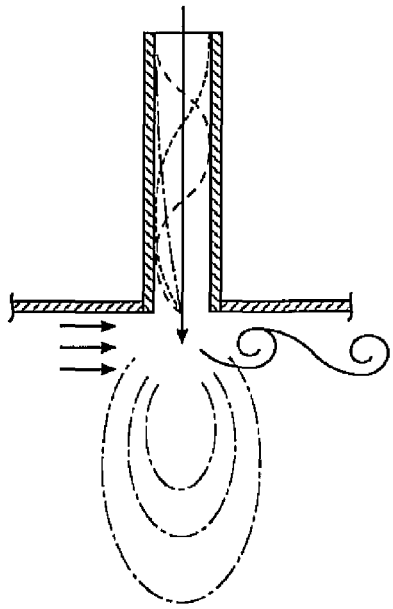
FIG. 3

DIPOLE FLOW DRIVEN RESONATORS FOR FAN NOISE MITIGATION

CROSS REFERENCE TO RELATED APPLICATIONS

This application claims priority to U.S. provisional patent application Ser. No. 61/061,352, filed Jun. 13, 2008 the entire content of which is incorporated herein by reference.

FIELD OF THE INVENTION

The present invention relates generally to acoustic resonators for use with fans.

BACKGROUND OF THE INVENTION

Axial turbomachinery noise is prevalent in many products ranging from large scale turbofan engines and compressor/turbine arrays to HVAC systems and computer cooling fans. Noise generated by turbomachinery has both broadband (due to the randomness of turbulent flow and its interaction with blade structures) and tonal components (due to periodic excitation of rotor blades and resonance sources). For subsonic axial fans, broadband noise results primarily from turbulent boundary layer scattering over a blade's trailing edge (TE), tip clearance noise and, potentially, from stall. Tonal noise results from rotor/stator interactions with time-invariant flow distortions and direct field interaction of rotor/stator blades. These tonal noise sources generally radiate axially for ducted fans as a dipole-like source. When spectrally dominant, blade tones are of primary concern in noise control applications due to their particular annoyance. Therefore, robust, cost-effective techniques for reducing their propagation are regularly sought.

Prior approaches used to reduce blade tone sound pressure levels (SPLs) have utilized both active and passive noise control methods. Passive blade alterations, such as rotor/stator spacing, leaning, sweeping or contouring, numbering, and irregular circumferential blade spacing, have been demonstrated effective for fan noise reduction. Also, absorbing liners or other duct cancellation techniques such as Herschel-Quincke tubes can reduce propagations of fan noise within a duct. Obstructions, such as cylindrical rods, can be placed in the near field of a rotor to generate an anti-phase secondary sound field which can then be tuned to reduce blade tone noise. However, difficulty in tuning the response of these interactions often limits their usefulness. Few passive approaches have demonstrated the ability to reduce blade tone noise locally in the blade region with minimal impact on fan efficiency.

Active noise control approaches have been used for blade tone noise reduction, introducing active secondary sources into the existing sound field of an axial fan. Conventional active approaches have used loudspeaker arrays to reduce levels of fan noise propagating down a duct. Due to the associated weight and non-compactness of loudspeakers, piezoelectric actuators have been used more recently as acoustic transducers imbedded into the stator vanes of axial fans to reduce tonal noise propagations. Air injections, either positioned to generate secondary sources through interaction with the rotor blades or used to improve flow non-uniformities generated by a body in a flow field, have been shown to reduce tonal noise. These approaches have proven effective in a laboratory setting, but are generally prohibitively expensive and potentially unreliable in most actual axial fan applications.

The first known implementation of flow-driven resonator source was to generate a canceling sound field that reduced fan noise generated by a centrifugal blower. More recently, a method of using resonators as flow driven secondary sources has been developed for axial fans. This method behaves as a form of active source cancellation wherein fluid flow interacts with a resonator as a means of generating an acoustic source. A single resonator has been shown to be effective for reducing unidirectional propagations of blade tone noise by as much as 24 dB, while an array of resonators equal to the number of stator vanes was used to reduce propagations of both plane-wave and higher order mode propagations by 28 dB.

A fundamental shortcoming of the single resonator axial fan experiments, particularly for plane wave propagations where fan noise radiates as an axially propagating dipole, is that flow driven resonators respond acoustically as monopole sources. For this reason, only unidirectional propagations of the plane wave mode can be reduced using a single resonator or circumferential array of resonators as shown in FIG. 1. While this results in a reduced noise level in one (in this case, downstream) direction, it also may cause an increased noise level in the other (in this case, upstream) direction.

SUMMARY OF THE INVENTION

The present invention provides a dipole acoustic resonator configuration which provides attenuation of bi-directional fan noise propagations, potentially canceling the entirety or a substantial portion of the tonal output of an axial fan. A fan system in accordance with the present invention includes a rotor supported for rotation about a fan axis. The rotor has a central hub and a plurality of blades each extending outwardly from the hub to a tip. The rotor blades define a rotor plane perpendicular to the fan axis. A first acoustic resonator has an opening disposed on a first side of the rotor plane and a second acoustic resonator has an opening that is disposed on a second side of the rotor plane. The acoustic resonators are configured to provide a dipole resonator system operable to at least partially reduce a blade pass frequency tone in an upstream and a downstream direction simultaneously. In some embodiments, the fan system has a primary operating speed with a primary blade pass frequency associated therewith. Each acoustic resonator has a resonance frequency which can either be tuned equivalently to the primary blade pass frequency for a maximum response or de-tuned to provide an appropriate reduced level of response allowing each of the paired resonators to respond identically in magnitude and oppositely in phase. In some embodiments, the resonance frequency is within 10% of the band pass frequency.

Each resonator may be generally tubular so as to form a quarter wavelength resonator. In some alternatives, each resonator has at least two sections. The first section extends from the opening to a first transition region and a second section extends from the first transition region to a second transition region. The resonators each have a first resonance frequency associated with the first section and a second resonance frequency associated with the combination of the first and second sections. Alternatively, each resonator may have an internal length that is adjustable such that the resonance frequency is adjustable.

In some versions, each resonator has a chamber in fluid communication with the openings such that each resonator is a Helmholtz resonator.

A fan system in accordance with the present invention may further include a shroud having an inner surface that defines an axial passage. The rotor is supported in the passage and the tips of the rotor are disposed adjacent the inner surface of the shroud. The openings of the first and second acoustic resonators are defined in the inner surface of the shroud. The system may further include a stator with a plurality of blades disposed generally in a stator plane. The openings of the acoustic resonators may each be disposed on the rotor side of the stator plane. In some versions, the shroud further has an outer surface and the resonators are disposed between the inner and outer surfaces of the shroud.

The rotor, when rotating, may be said to define a rotor volume with a surface. The openings of the acoustic resonators may each be adjacent to the surface of the rotor volume. In some versions, the openings are adjacent the portion of the rotor volume defined by the tips of the rotor blades. Alternatively, the openings may be adjacent to the portion of the rotor volume defined by the hub of the rotor.

In some versions, the openings of the acoustic resonators are disposed in a line parallel to the fan axis such that the openings are at the same circumferential position with respect to the rotor. In other versions, the first and second acoustic resonators form a first set of resonators and the system further comprises at least one additional set of the first and second acoustic resonators spaced from the first set.

According to further embodiments of the present invention, a fan system includes a rotor supported for rotation about a fan axis. The rotor has a plurality of blades each having a leading edge, a trailing edge and a tip. The rotor blades define a rotor plane perpendicular to the fan axis. A first acoustic resonator and a second acoustic resonator are each driven by the rotor blades. The resonators are configured to provide a dipole resonator system operable to at least partially reduce a blade pass frequency tone in an upstream and a downstream direction simultaneously. In some versions, a stator is disposed adjacent the rotor, with the stator having a plurality of blades disposed generally in a stator plane. In some versions, the acoustic resonators each have openings that disposed on the rotor side of the stator plane. In further versions, the first acoustic resonator has an opening disposed on a first side of the rotor plane and a second acoustic resonator has an opening disposed on a second side of the rotor plane.

BRIEF DESCRIPTION OF THE DRAWINGS

FIG. 1 is an illustration of noise cancellation using a monopole sound source with an axial fan system;

FIG. 2 is an illustration of noise cancellation with a dipole resonator configuration as part of a fan system in accordance with the present invention;

FIG. 3 illustrates the way in which a passing rotor blade tip drives a resonator;

DETAILED DESCRIPTION OF THE PREFERRED EMBODIMENTS

The present invention provides a dipole acoustic resonator configuration for use with or as part of a fan system so as to provide attenuation of bi-directional fan noise propagations, potentially locally canceling the entirety or a substantial portion of the tonal output of an axial fan.

Figure 5:
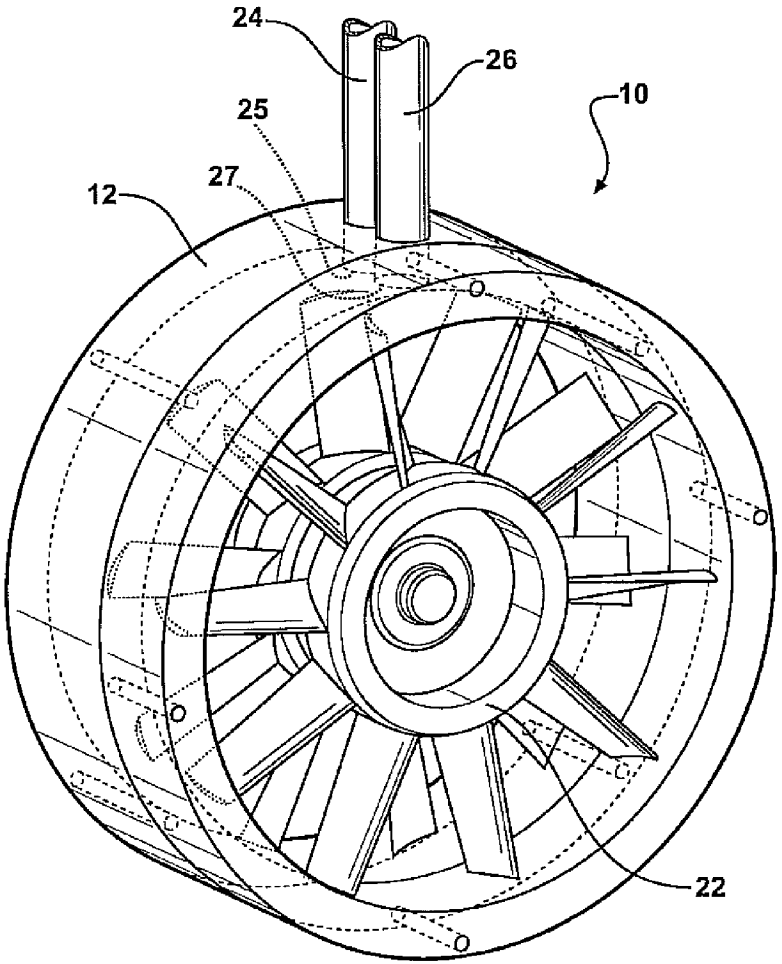
FIG. 5 is another perspective view of the fan system of FIG. 4.
Figure 4:
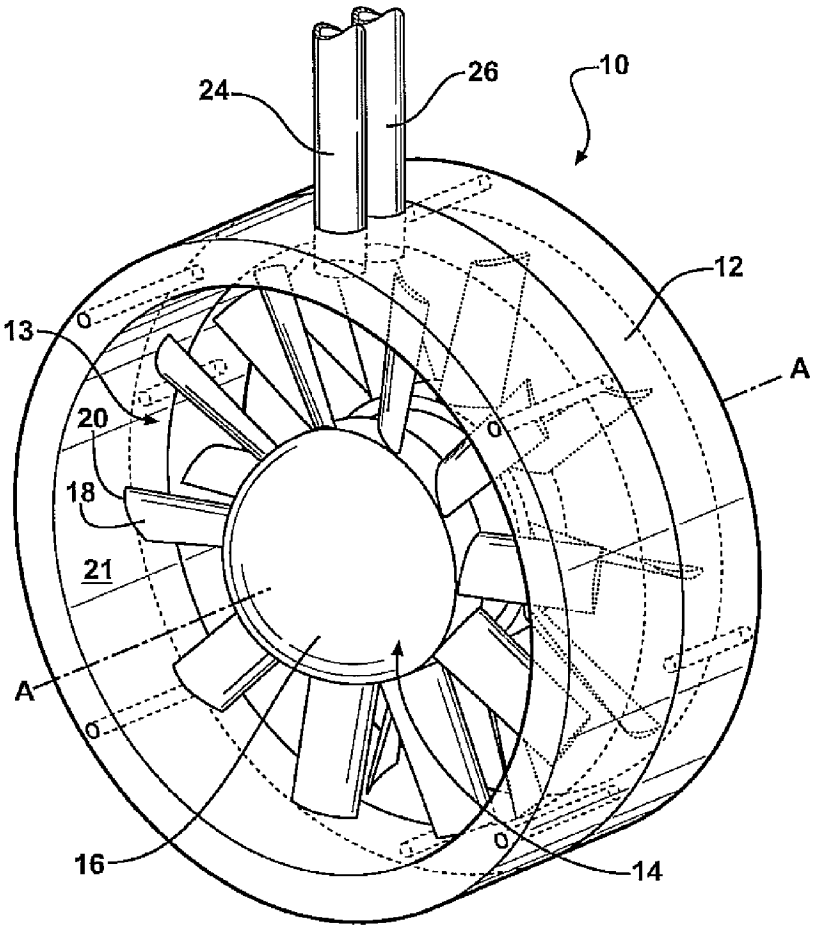
FIG. 4 is a perspective view of a fan system in accordance with a first embodiment of the present invention.

Referring to FIGS. 4 and 5, an axial fan system 10 according to an embodiment of the present invention includes a shroud 12 that generally defines a passage 13 having a fan axis A. A rotor 14 is disposed in the passage and rotates about the axis A. As shown, the rotor 14 has a central hub 16 and a plurality of rotor blades 18 extending outwardly from the hub 16 to tips 20 near an inner surface 21 of the shroud 12. The system 10 also includes a stator 22 that is adjacent the rotor 14. The stator 22 supports the rotor hub so that the rotor can rotate about the axis. The stator may take a variety of forms. In the illustrated embodiment, the stator 22 has a plurality of blades that extend between a central hub and tips that are attached to the shroud.

The system according to the present invention includes a dipole resonator configuration to reduce the tonal output of the axial fan. In the embodiment of FIGS. 4 and 5, the dipole resonator configuration includes a pair of acoustic resonators 24 and 26 that are each driven by the passing fan blade tips. Each resonator creates a tone or sound with a frequency, a phase, and a magnitude. As will be clear to those of skill in the art, the resonators may be configured to create tones operable to reduce the blade pass frequency tones of the fan system due to noise cancellation between the resonator tones and the fan system tones.

While the acoustic resonators 24 and 26 may take forms other than shown, the illustrated embodiment uses closed ended tubular resonators each with an opening, 25 and 27 respectively, in the inner surface 21 of the shroud 12 near the passing rotor blade tips 20. Only a portion of each acoustic resonator is shown in FIGS. 4 and 5, with it being understood that the tubular resonators would be substantially longer in most actual applications.

FIG. 3 illustrates the mechanism by which such acoustic resonators are driven by passing fan blades. This use of resonators is fundamentally different from conventional use of resonators as duct silencers and is described in detail in L. J. Gorny, G. H. Koopmann, W. Neise, O. Lemke, "Attenuation of Ducted Axial Propulsors' Blade Tone Noise Using Adaptively Tunable Resonators" AIAA 2007-3529 (13th AIAA/CEAS Aeroacoustics Conference, Rome, Italy, 2007), which is incorporated herein by reference.

Basically, the passing blade tips 20 generate periodic pressure fluctuations at the mouth or opening of each resonator, thereby forcing a resonator response. As shown in FIG. 2, a pair of resonators 24 and 26 are disposed adjacent the rotor blade tips. They are disposed with their openings in the inner surface of the shroud.

In the illustrated embodiment, the rotor blades 18 may be said to define and generally be disposed along a rotor plane R, as shown in FIG. 2. The plane R is generally at the midpoint of the rotor blades and perpendicular to the fan axis about which the rotor rotates. The openings of the resonators may be said to be on opposite sides of this rotor plane in the illustrated embodiment. Alternatively, the resonator openings may be positioned differently than shown. Also as shown, each resonator opening is preferably disposed at the same circumferential position. Alternatively, they many not be at the same circumferential position.

Figure 8:
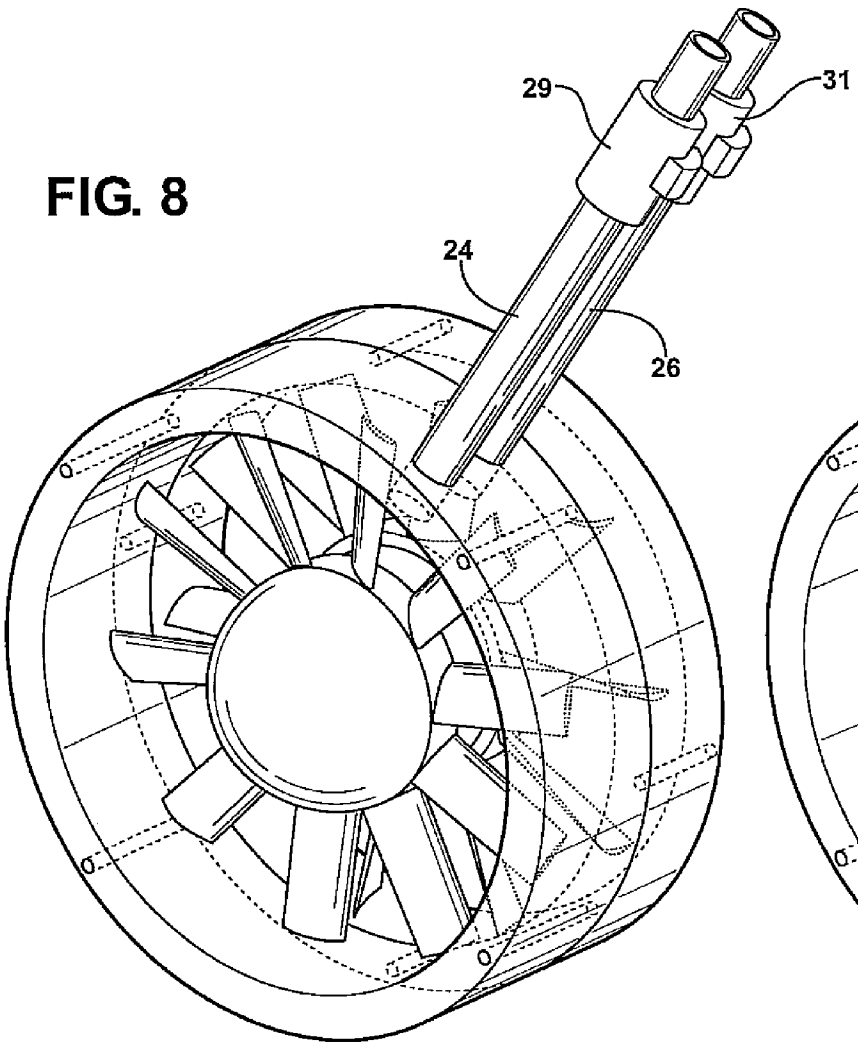
FIG. 8 is a perspective view of the first embodiment of the present invention showing the entirety of the resonators.

Referring now to FIG. 8, the embodiment of FIGS. 2, 4 and 5 is shown with the entire length of exemplary acoustic resonators 24 and 26 shown. As will be clear to those of still in the art, the length of the resonators depends on the resonance frequency required. For the illustrated configuration, the length of each resonator is one quarter of the wavelength of the resonance frequency of the resonator. As known to those of skill in the art, the dominant tone of typical axial fans occurs at the blade pass frequency. The resonators may be tuned so as to provide a dipole sound source operable to cancel at least a portion of the blade pass frequency tone in both the upstream and downstream directions. Each acoustic resonator has a resonance frequency which can either be tuned equivalently to the primary blade pass frequency for a maximum response or de-tuned to provide an appropriate reduced level of response allowing each of the paired resonators to respond identically in magnitude and oppositely in phase. In some embodiments, the resonance frequency is within 10% of the band pass frequency. Also, the two resonators may be tuned to different resonance frequencies in order to provide the desired response.

FIG. 2 illustrates cancellation of sound waves using a properly tuned system. The original upstream sound signal is shown at 28 and the original downstream sound signal is shown at 30. The upstream output of the dipole sound source created by the resonators is shown at 32 and the downstream output of the dipole sound source is shown at 34. The output of the resonators is 180 degrees out of phase with the original sounds, thereby cancelling at least a portion of the original signal. The resulting sound wave is shown at 36 upstream, and 38 downstream. As will be clear to those of skill in the art, FIG. 2 illustrates the sound signals diagrammatically. Referring again to FIG. 1, and comparing FIG. 1 to FIG. 2, it can be seen that the monopole source reduces the amplitude of the sound in one direction but actually amplifies it in the other.

As known to those of skill in the art, the blade pass frequency of an axial fan depends on the rotational speed of the rotor. In many applications the speed is predetermined. That is, the fan system is designed such that the fan speed is a constant predetermined speed. For applications such as these, a resonator with a predetermined resonance frequency, such as determined by a predetermined length of a quarter wavelength resonator, may be used to provide a dipole resonator system in accordance with the present invention. In other applications, it may be desirable to provide a resonator with adjustable characteristics. FIG. 8 illustrates optional adjusting mechanisms 29 and 31 at the end of each resonator tube that are operable to adjust the internal length of the tube. Other approaches for adjusting the resonance frequency or other characteristics of the resonators will be clear to those of skill in the art.

Figure 7:
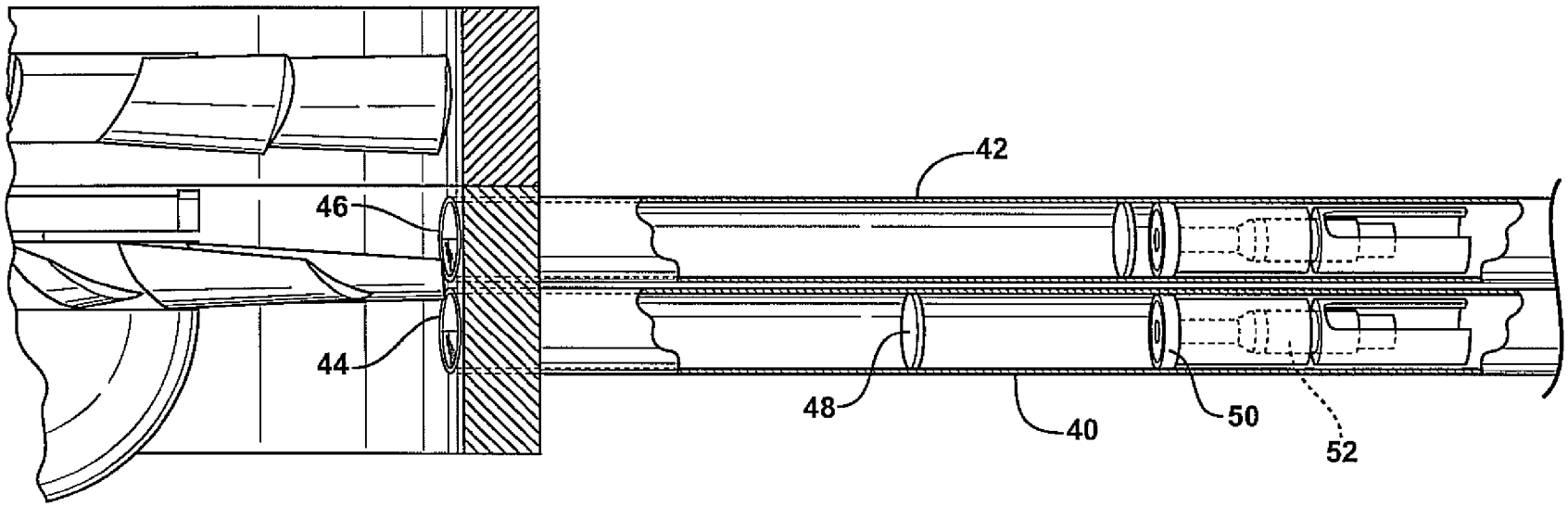
FIG. 7 is a cutaway view of a portion of a resonator system that forms part of a fan system in accordance with a third embodiment of the present invention.

FIG. 7 illustrates an embodiment of a fan system in accordance with the present invention including a dipole resonator configuration with a pair or resonators having adjustable elements. As with the earlier embodiments, a first acoustic resonator 40 and a second acoustic resonator 42 are provided. The resonators 40 and 42 each have an opening, 44 and 46, respectively, with these openings being disposed on opposite sides of a rotor plane defined by the rotor blades. Referring to the first acoustic resonator 40, an adjustable fabric wall is shown at 48. As known to those of skill in the art, the fabric wall adjusts the impedance of the resonator. Resonator 40 has an end wall 50 with a microphone assembly 52 which may be included for feedback or tuning purposes. Adjustable configurations as shown in FIGS. 7 and 8 may be used for initially tuning a resonator system or adjustable elements may be used for actively adjusting the characteristics of the resonator in operation, such as with a variable speed fan system. As also shown in FIG. 7, the openings 44 and 46 may be partially blocked. In the illustrated embodiment, each opening is half blocked so as to increase the effective distance between the resonators. Such an approach may also be used to change the effective axial positioning of each resonator mouth or opening in the blade tip region.

Figure 6:
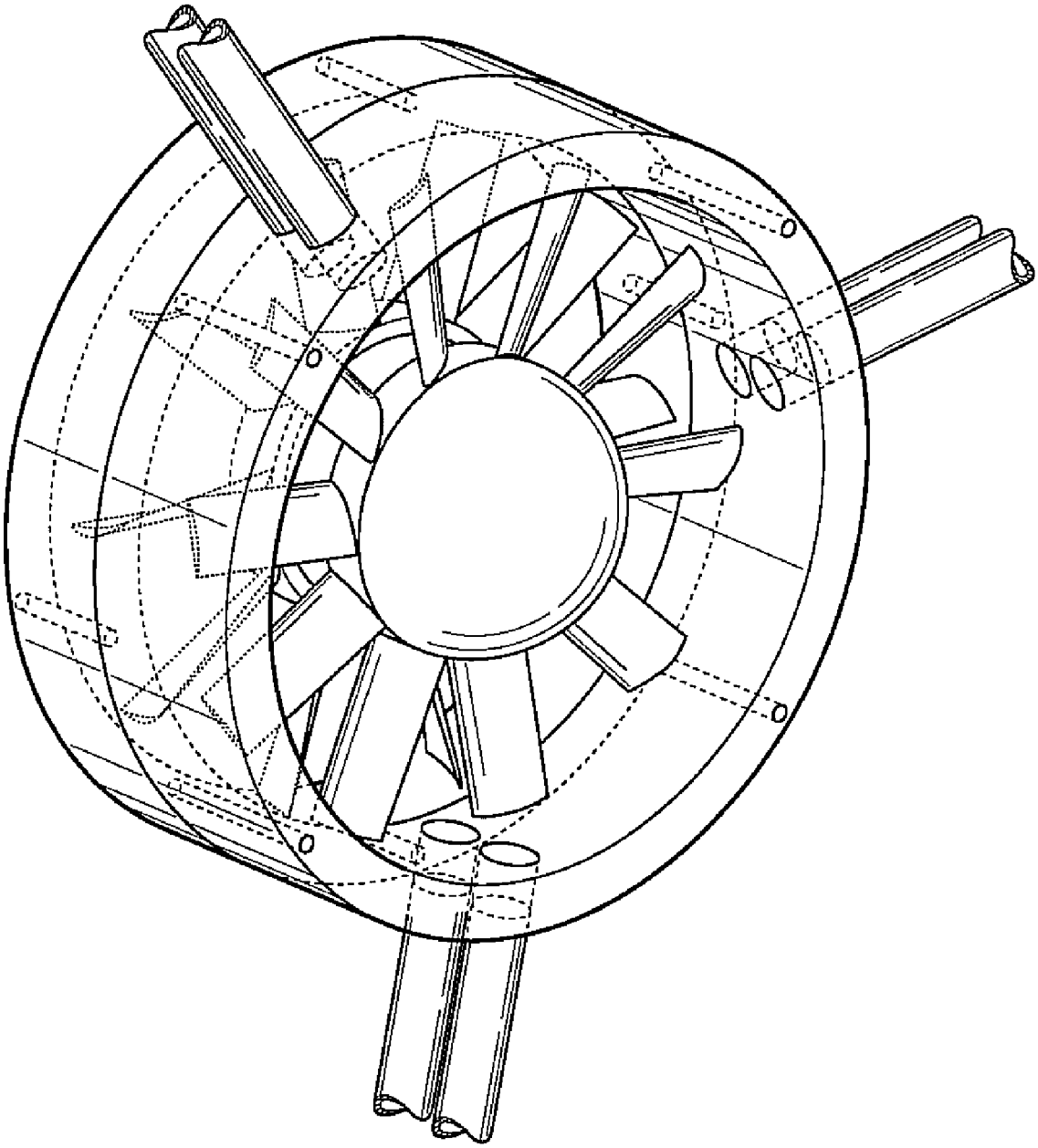
FIG. 6 is a perspective view of a second embodiment of a fan system in accordance with the present invention.

Referring now to FIG. 6, an alternative embodiment of the present invention is shown using three sets of acoustic resonators spaced apart circumferentially around the fan shroud. Each set includes a first and second acoustic resonator with openings disposed on opposite sides of the rotor plane defined by the blades of the rotor. For some embodiments, such a configuration provides improved performance.

Figure 9:
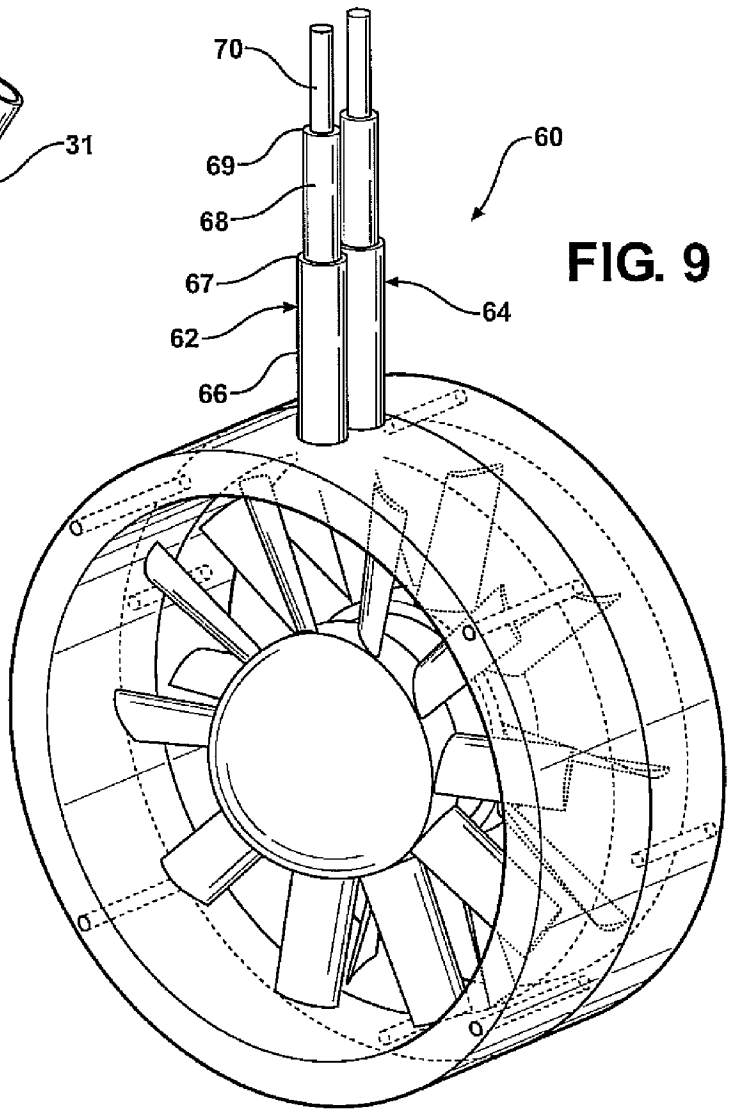
FIG. 9 is a perspective view of a fourth embodiment of a fan system according to the present invention with quarter wavelength resonators having varying cross sections.

Referring now to FIG. 9, another embodiment of a fan system in accordance with the present invention is shown at 60. As with earlier embodiments, a first acoustic resonator 62 and a second acoustic resonator 64 are provided for a dipole resonator system operable to cancel at least a portion of the blade pass frequency tone. The resonator 62 and 64 in this embodiment differ from earlier embodiments in that each resonator has more than one section. The resonators in FIG. 9 have three sections, though two sections or more than three sections are also possible. Referring to resonator 62, the resonator has a first section 66, second section 68 and a third section 70. Each section is generally tubular with section 70 being a small diameter, section 68 being a medium diameter, and section 66 being a large diameter. The three sections are joined end to end so that the inside of the resonator 62 has a first diameter section 66 that extends from the opening to a first transition region 67 where the inside diameter steps down to the smaller diameter second section 68. A second transition region 69 occurs where the inside diameter of the section 68 steps down to the smaller diameter of section 70. As known to those of skill in the art, a resonator with this configuration can perform as three individual quarter wavelength resonator tubes with the effective length of the three tubes being equal to the total length of the three sections, the combined length of the first and second sections, and the length of the first section. While the three sections 66, 68 and 70 are illustrated as being similar in length, this is not necessary. As will be clear to those of skill in the art, the use of resonators with multiple resonance frequencies may be useful where a fan system has multiple speeds or it is desired to cancel more than one signal. As will be clear to those of skill in the art, other forms of resonators with multiple resonance frequencies may also be used.

Figure 10:
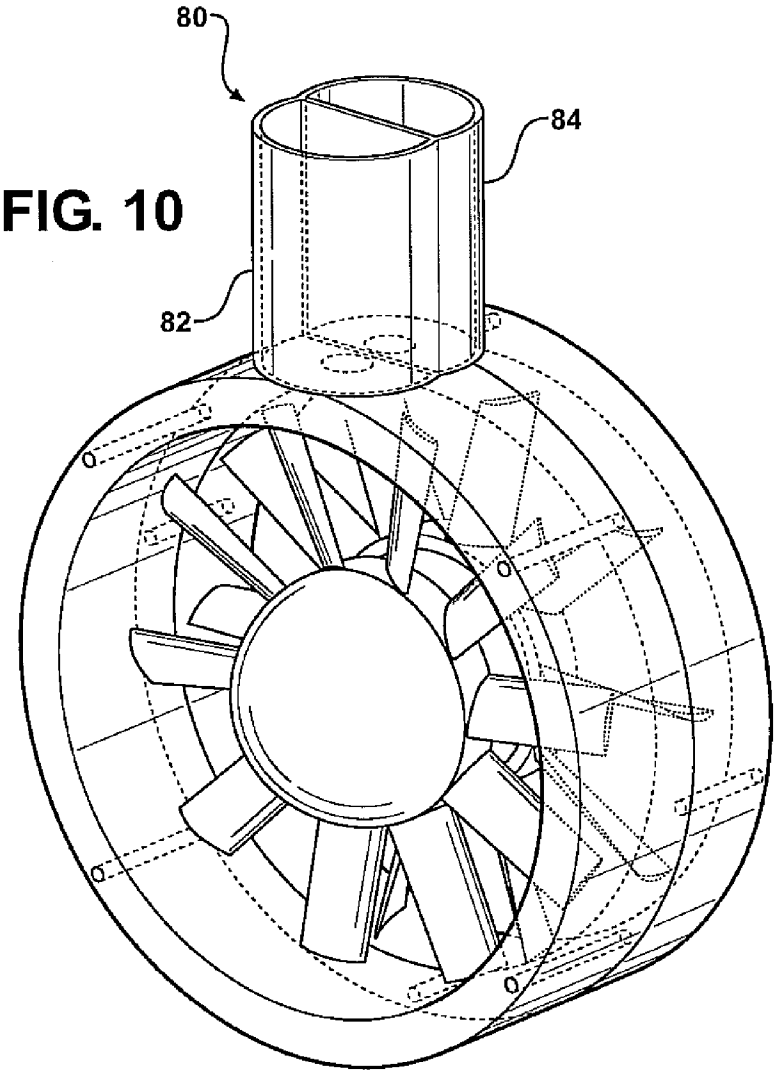
FIG. 10 is a perspective view of a fifth embodiment of a fan system in accordance with the present invention utilizing Helmholtz resonators.

Referring to FIG. 10, yet another embodiment of a fan system with a dipole resonator system is illustrated at 80. In this embodiment, the resonators 82 and 84 each take the form of Helmholtz resonators. These resonators have openings that are in fluid communication with a large resonance chamber. As known to those of skill in the art, Helmholtz resonators perform somewhat differently than quarter wavelength resonators. For example, a Helmholtz resonator may have a lower magnitude response than a quarter wavelength resonator. On the other hand, a Helmholtz resonator may be easier to package. In one example, the resonance chamber of the Helmholtz resonator may be packaged between inner and outer surfaces of the shroud.

Figure 11:
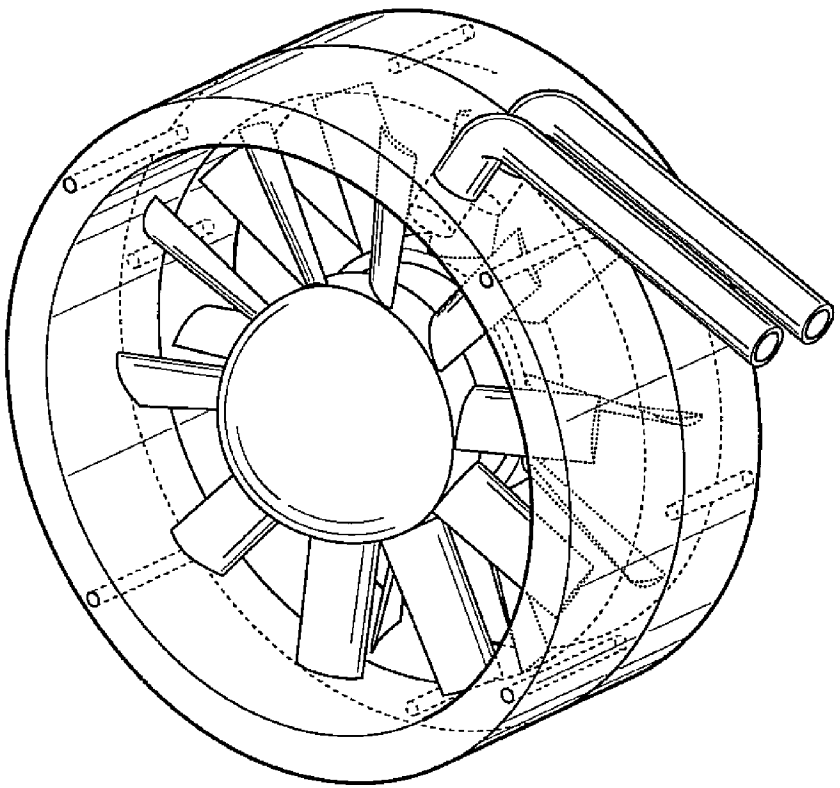
FIG. 11 is a perspective view of a sixth embodiment of a fan system in accordance with the present invention.
Figure 12:
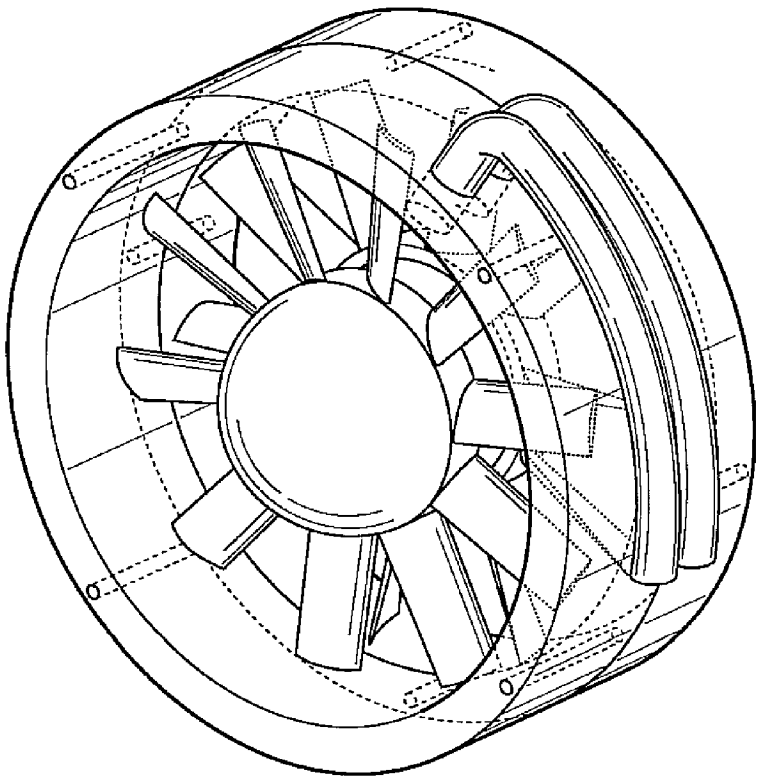
FIG. 12 is a perspective view of a seventh embodiment of a fan system in accordance with the present invention.

Referring now to FIG. 11, the use of bent quarter wavelength tubes is illustrated. In this embodiment, the resonators are each tubes that are bent at a 90 degree angle in order to improve packaging. FIG. 12 illustrates yet another embodiment in which the tubes are shaped so as to follow the contour of the fan shroud. The tubes may be housed between the inner and outer surfaces of the shroud.

Figure 13:
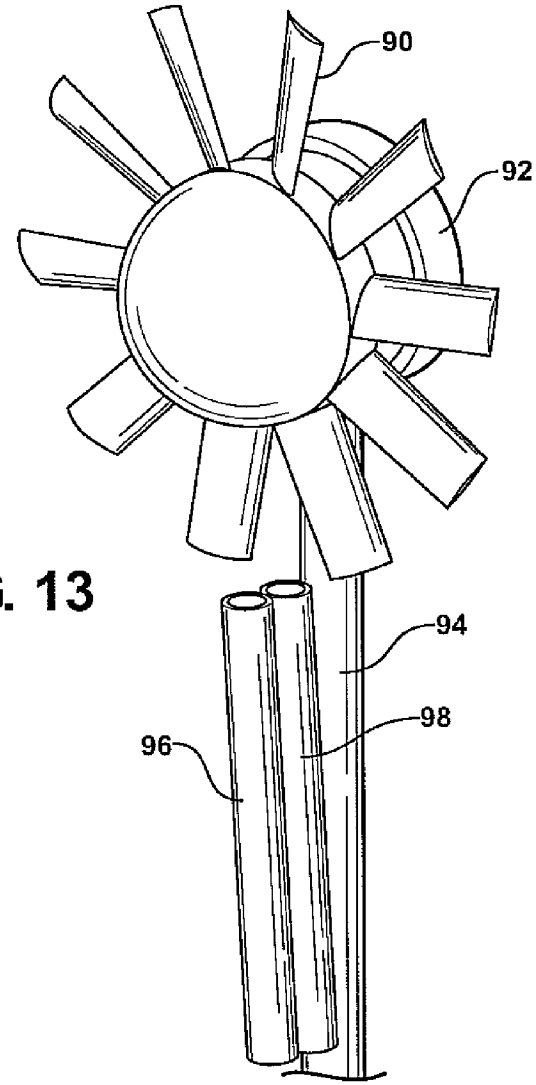
FIG. 13 is a perspective view of a eighth embodiment of a fan system in accordance with the present invention.

Thus far, the illustrated embodiments of the present invention have included a fan shroud with the openings of the resonators being disposed in the inner surface of the shroud. However, there are many applications in which a non-ducted fan is used. Dipole resonators in accordance with the present invention may be used in a fan system that is non-ducted. FIG. 13 illustrates an embodiment wherein a rotor 90 is supported by a fan support 92, which in turn is supported by a support structure 94. This would be typical of wind turbine applications. A pair of resonators, 96 and 98, are illustrated with their openings positioned in accordance with the earlier discussion. That is, the openings of the resonators 96 and 98 are disposed on opposite sides of a rotor plane defined by the blades of the rotor 90.

Figure 15:
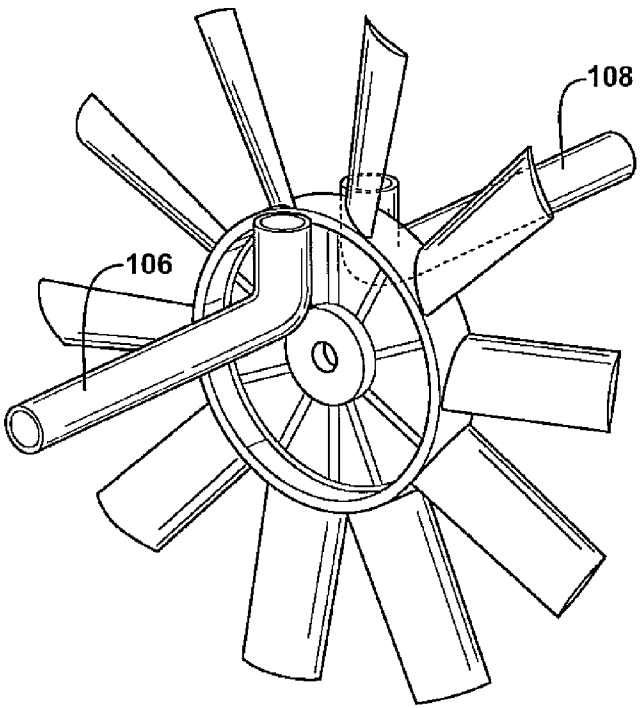
FIG. 15 is a perspective view of a tenth embodiment of a fan system in accordance with the present invention.
Figure 14:
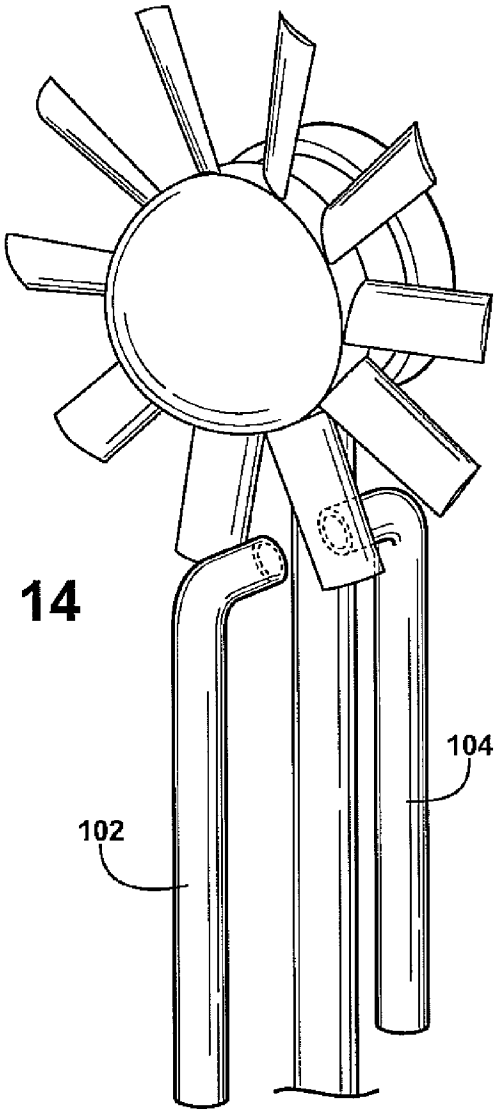
FIG. 14 is a perspective view of a ninth embodiment of a fan system in accordance with the present invention.

In the embodiments discussed thus far, the openings of the resonators are disposed adjacent the tips of the rotor blades. When the rotor rotates, the rotor may be said to define a rotor volume. This is the volume swept by the rotor and any element extending into this volume would be struck by some part of the rotor, such as one of the blades. In other embodiments of the present invention, openings of resonators may be disposed adjacent the surface of this rotor volume so as to be driven by the portion of the rotor passing this opening. As used herein, adjacent means close to the surface, and encompasses a spacing between the surface and the openings as long as the spacing does not defeat the function of the resonators. FIG. 14 illustrates an embodiment wherein the first and second resonators 102 and 104 have openings disposed adjacent the blade cord so as to be driven thereby. FIG. 15 illustrates yet another embodiment wherein the openings of the resonators 106 and 108 are disposed within the stator hub of the fan so as to interact with pressures at either side of the blades at the rotor's inner radius. This is primarily of interest for cascaded arrays of blades in stators, though may also be used for other applications. The resonators may be stationary or, alternatively, may rotate with the rotor and interact with the adjacent stator vanes.

We turn now to a general discussion of the concepts underlying the present invention. As known to those of skill in the art, in order to achieve a greater level of response, the dipole resonators must be driven nearer to resonance than would be necessary with the monopole sources of FIG. 1. This necessity is advantageous due to the variability of resonator magnitude and phasing near resonance, meaning that if resonators are not being driven exactly out of phase by the fan blades directly, these phase variations can be corrected with slight length corrections of a single resonator. Differences in the magnitude of response can be eliminated using back-wall tuning. A disadvantage to operating near resonance is that tunings must be precise, due to the instability of the system in this region.

As shown in previous work, the magnitude of the BPF pressure incident on an axial fan's shroud is greatest near the leading edge of a fan blade and it tapers off fairly equally to both sides of the blade. As known to those with skill in the art, the axial phase change across the blades of a fan is approximately 180 degrees. With one particular fan used in developing the invention, the phase change was approximately 164 degrees for mid to higher loading conditions. As known to those with skill in the art, for the resonators, the phase change through resonance is 180 degrees as well, and a flow driven resonator responds at each resonance as a damped second order system. A combination of these phasing effects allows for resonators to be driven appropriately to generate a dipole by positioning them on opposite sides of the blade passing region or the rotor plane.

The current procedure for developing resonators to reduce the bi-directional radiation of BPF tonal noise from a fan is through trial and error. Baseline measurements of the upstream and downstream SPLs are recorded both in terms of magnitude and phase (relative to a stationary optical tachometer located midway between stator vanes) without the resonators in place. The two resonators are then positioned and the fan is run, this time recording the resonator back-wall pressures, along with the fan's sound pressure level. The lengths of each resonator are modified to find relative positions where the measured back-wall pressures are 180 degrees out of phase and of similar magnitude. Microphones as shown in FIG. 7 may be used to measure back-wall pressures.

Once a dipole response is obtained, the circumferential position of the resonators is rotated slowly between two adjacent stator vanes, paying particular attention to the phase of the upstream and downstream resulting pressure fields. This determines the circumferential positions where the dipole resonator responses are in-phase and out-of-phase with the radiated fan noise. Having determined appropriate positions, the resonators are then moved to the optimal out-of-phase position. From here, the resonators are tuned by modifying the position of a fabric wall and the total length parameters (still ensuring dipole response by monitoring the two back-wall pressure measurements and correcting for variation) to achieve an appropriate magnitude of the dipole response. Circumferential positioning must also be modified to a new out-of-phase position, compensating for phase changes in the tuning of the resonators. Repetition of these steps optimizes resonator response for a specific fan speed and loading condition. After a few iterations, an optimal resonator location is found and bidirectional noise propagations are reduced. As will be clear to those of skill in the art, other approaches to tuning may also be used.

When the dipole system is properly tuned, the two resonators produce tones that are exactly or almost exactly 180 degrees out of phase from each other. Preferably the tones produced by the two resonators are within a few degrees of being exactly 180 degrees out of phase with each other resulting in purely a dipole like response. Detuning the dipole response slightly will allow for bias of the radiated sound field in a particular direction and can be beneficial for fan noise cases where noise in one direction is dominant. Generally, it is preferred that the tones produced by the two resonators are within 5 degrees, inclusive, of 180 degrees out of phase with each other. Being within 2 degrees of 180 degrees out of phase is more preferred for some applications. Further discussion of testing and development of embodiments of the present invention are provided in Gorny, L. J., Koopmann, G. H., and Capone, D. E "Use of Dipole Resonator Configurations for Bi-Directional Attenuation of Plane Wave Blade Tone Noise Propagation," Proceedings of Noise-Con 2008, Detroit, Mich., 9 pp. (July 2008), the entire contents of which are incorporated herein by reference.

As will be clear to those of skill in the art, the herein described embodiments of the present invention may be altered in various ways without departing from the scope or teaching of the present invention. It is the following claims, including all equivalents, which define the scope of the present invention.

The invention claimed is:

1. A fan system with dipole flow driven resonators for attenuation of noise, the system comprising:

a rotor supported for rotation about a fan axis, the rotor having a central hub and a plurality of blades each extending outwardly from the hub to a tip, the rotor blades defining a rotor plane perpendicular to the fan axis;

a first acoustic resonator having an opening disposed on a first side of the rotor plane; and a second acoustic resonator having an opening being disposed on a second side of the rotor plane;

the acoustic resonators being configured and positioned so as to be flow driven by the tips of the blades as the tips pass the openings of the resonators, the resonators being tuned such that the resonators respond acoustically as a flow driven dipole sound source operable to at least partially reduce a blade pass or higher harmonic frequency tone in an upstream and a downstream direction simultaneously, the first and second acoustic resonators being tuned to be generally 180 degrees out of phase with one another and to radiate generally the same magnitude of energy so as to respond acoustically as the dipole sound source.

2. A fan system according to claim 1, wherein the fan system has a primary operating speed with a primary blade pass frequency associated therewith, each acoustic resonator having a resonance frequency within approximately 10% of the primary blade passage frequency.

3. A fan system according to claim 1, wherein each resonator is generally tubular so as to form a quarter wavelength resonator.

4. A fan system according to claim 3, wherein each resonator has at least two sections, a first section extending from the opening to a first transition region and a second section extending from the transition region to a second transition region, the resonators each having a first resonance frequency associated with the first section and a second resonance frequency associated with the combination of the first and second sections.

5. A fan system according to claim 3, wherein each resonator having an internal length, the internal length being adjustable such that the resonance frequency is adjustable.

6. A fan system according to claim 1, wherein each resonator has a chamber in fluid communication with the opening such that each resonator is a Helmholtz resonator.

7. A fan system according to claim 1, further comprising a shroud having an inner surface defining an axial passage through the shroud, the rotor being supported in the passage and the tips of the rotor being disposed adjacent the inner surface of the shroud, the openings of the first and second acoustic resonators being defined in the inner surface of the shroud.

8. A fan system according to claim 7, further comprising a stator, the stator having a plurality of blades disposed generally in a stator plane, the openings of the acoustic resonators each being disposed on the rotor side of the stator plane.

9. A fan system according to claim 7, wherein the shroud further has an outer surface, the resonators each being disposed between the inner and outer surfaces of the shroud.

10. A fan system according to claim 1, wherein the rotor when rotating defines a rotor volume with a surface, the openings of the acoustic resonators each being adjacent the surface of the rotor volume.

11. A fan system according to claim 10, wherein the openings are adjacent the portion of the rotor volume defined by the tips of the rotor blades.

12. A fan system according to claim 10, wherein the openings are adjacent the portion of the rotor volume defined by the hub of the rotor.

13. A fan system according to claim 1, wherein the openings of the acoustic resonators are disposed in a line parallel to the fan axis such that the openings are at the same circumferential position with respect to the rotor.

14. A fan system according to claim 1, wherein the first and second acoustic resonators form a first set of resonators, the system further comprising at least one additional set of first and second acoustic resonators spaced from the first set.

15. A fan system according to claim 1, wherein when the rotor spins at an operational speed, the first resonator produces a first tone and the second resonator produces a second tone, the first and second tones being 175 to 185 degrees out of phase with each other.

16. A fan system with dipole flow driven resonators for attenuation of noise, the system comprising:

a rotor supported for rotation about a fan axis, the rotor having a plurality of blades each having a leading edge, a trailing edge and a tip, the rotor blades defining a rotor plane perpendicular to the fan axis;

a first acoustic resonator flow driven by the rotor blades; and a second acoustic resonator flow driven by the rotor blades;

the acoustic resonators being configured and positioned so as to be flow driven by the rotor blades as the rotor blades pass openings of the resonators, the resonators being tuned such that the resonators respond acoustically as a flow driven dipole sound source operable to at least partially reduce a blade pass or higher harmonic frequency tone in an upstream and a downstream direction simultaneously, the first and second acoustic resonators being tuned to be generally 180 degrees out of phase with one another and to radiate generally the same magnitude of energy so as to respond acoustically as the dipole sound source.

17. A fan system according to claim 16, further comprising:

a stator disposed adjacent the rotor, the stator having a plurality of blades disposed generally in a stator plane, the acoustic resonators each having openings, the openings both being disposed on the rotor side of the stator plane.

18. The fan system according to claim 16, wherein the first acoustic resonator has an opening disposed on a first side of the rotor plane and the second acoustic resonator has an opening disposed on a second side of the rotor plane.

19. The fan system according to claim 1, wherein:

the first and second acoustic resonators are each adjustable such that they are tunable to be generally 180 degrees out of phase with one another by compensating for non-ideal acoustic pressures incident on a shroud of the fan system to radiate generally the same magnitude of energy so as to respond acoustically as the dipole source.

20. A fan system with dipole flow driven resonators for attenuation of noise, the system comprising:

a rotor supported for rotation about a fan axis, the rotor having a central hub and a plurality of blades each extending outwardly from the hub to a tip, the rotor defining a rotor plane perpendicular to the fan axis, the rotor rotating to define a rotor volume swept by the rotor;

a first acoustic resonator having an opening disposed adjacent the rotor volume; and a second acoustic resonator having an opening adjacent the rotor volume;

the acoustic resonators being configured and positioned so as to be flow driven by the blades as the blades pass the openings of the resonators, the resonators being tuned such that the resonators respond acoustically as a flow driven dipole sound source operable to at least partially reduce a blade pass or higher harmonic frequency tone in an upstream and a downstream direction simultaneously, the first and second acoustic resonators being tuned to be generally 180 degrees out of phase with one another and to radiate generally the same magnitude of energy so as to respond acoustically as the dipole sound source.

* * * * *